US010828227B2

(12) United States Patent
Tagami

(10) Patent No.: US 10,828,227 B2
(45) Date of Patent: Nov. 10, 2020

(54) APPROPRIATE PRESSURE DETERMINATION DEVICE, APPROPRIATE PRESSURE DETERMINATION SYSTEM, AND METHOD FOR DETERMINING APPROPRIATE PRESSURE

(71) Applicant: HUMAN LINK CO., LTD., Asaka-shi, Saitama (JP)

(72) Inventor: Katsutoshi Tagami, Asaka (JP)

(73) Assignee: HUMAN LINK CO., LTD., Asaka (JP)

( * ) Notice: Subject to any disclaimer, the term of this patent is extended or adjusted under 35 U.S.C. 154(b) by 489 days.

(21) Appl. No.: 15/736,816

(22) PCT Filed: Nov. 9, 2016

(86) PCT No.: PCT/JP2016/083177
§ 371 (c)(1),
(2) Date: Dec. 15, 2017

(87) PCT Pub. No.: WO2017/082274
PCT Pub. Date: May 18, 2017

(65) Prior Publication Data

US 2018/0229064 A1 Aug. 16, 2018

(30) Foreign Application Priority Data

Nov. 11, 2015 (JP) ..... 2015-221614

(51) Int. Cl.
*A61H 9/00* (2006.01)
*A63B 24/00* (2006.01)
(Continued)

(52) U.S. Cl.
CPC ..... *A61H 9/0078* (2013.01); *A61H 9/00* (2013.01); *A61H 9/005* (2013.01); *A61H 9/0092* (2013.01);
(Continued)

(58) Field of Classification Search
CPC ..... A61H 7/00; A61H 7/001; A61H 7/007; A61H 9/00; A61H 9/0007; A61H 9/005;
(Continued)

(56) References Cited

U.S. PATENT DOCUMENTS 8,328,693 B2 * 12/2012 Sato ..... A63B 21/00076 482/4
9,545,536 B2 * 1/2017 Sato ..... A63B 21/0023
(Continued)

FOREIGN PATENT DOCUMENTS

JP 2008-099842 A 5/2008
JP 2008-167786 A 7/2008
(Continued)

OTHER PUBLICATIONS

PCT Notification of Transmittal of Translation of the International Preliminary Report on Patentability dated May 24, 2018 in International Application No. PCT/JP2016/083177.
(Continued)

*Primary Examiner* — Colin W Stuart
(74) *Attorney, Agent, or Firm* — Plumsea Law Group, LLC

(57) ABSTRACT

A method of determining a more suitable appropriate pressure for use in muscle strength enhancement methods involving the restriction of blood flow.
The pressure of air in a gas bladder of a compression band is temporarily increased to a pressure higher than a presumed appropriate pressure and then gradually reduced. During this process, a pulse wave amplitude is measured, and a maximum pulse wave pressure, which is the pressure of the air in the gas bladder at a time when the pulse wave amplitude that is temporarily increased and then reduced has its maximum value is specified by a maximum pulse wave pressure specifying unit 12E. The unit 12E sends maximum
(Continued)

pulse wave pressure data representing a maximum pulse wave pressure to an appropriate pressure calculating unit 12F. The unit 12F multiplies the maximum pulse wave pressure by a coefficient to obtain an appropriate pressure.

6 Claims, 6 Drawing Sheets

(51) Int. Cl.
*A63B 69/00* (2006.01)
*A63B 21/008* (2006.01)
*A63B 21/00* (2006.01)

(52) U.S. Cl.
CPC ..... *A63B 21/008* (2013.01); *A63B 21/4017* (2015.10); *A63B 24/00* (2013.01); *A63B 69/00* (2013.01); *A63B 69/0059* (2013.01); *A61H 2201/0103* (2013.01); *A61H 2201/50* (2013.01); *A61H 2201/5007* (2013.01); *A61H 2201/5056* (2013.01); *A61H 2201/5058* (2013.01); *A61H 2201/5071* (2013.01); *A61H 2230/06* (2013.01); *A61H 2230/065* (2013.01); *A61H 2230/25* (2013.01); *A61H 2230/255* (2013.01); *A61H 2230/30* (2013.01); *A61H 2230/305* (2013.01); *A63B 24/0087* (2013.01); *A63B 2208/053* (2013.01); *A63B 2209/10* (2013.01); *A63B 2213/006* (2013.01); *A63B 2220/56* (2013.01)

(58) Field of Classification Search
CPC .. A61H 9/0078; A61H 9/0085; A61H 9/0092; A61H 2201/0103; A61H 2201/1635; A61H 2201/50; A61H 2201/5007; A61H 2201/5056; A61H 2201/5058; A61H 2201/5071; A61H 2205/06; A61H 2205/10; A61H 2230/06; A61H 2230/04; A61H 2230/065; A61H 2230/25; A61H 2230/255; A61H 2230/30; A61H 2230/305; A63B 21/008; A63B 21/4017; A63B 24/00; A63B 69/0059
See application file for complete search history.

(56) References Cited

U.S. PATENT DOCUMENTS

| | | | | |
|---|---|---|---|---|
| 9,775,619 | B2 * | 10/2017 | Sato | A63B 21/0085 |
| 2001/0000262 | A1 * | 4/2001 | McEwen | A61H 9/0078 601/11 |
| 2011/0060231 | A1 * | 3/2011 | Sato | A63B 21/0023 600/500 |
| 2011/0125036 | A1 * | 5/2011 | Nakajima | A61F 5/34 600/500 |

FOREIGN PATENT DOCUMENTS

| | | | |
|---|---|---|---|
| JP | 4839179 | B2 | 12/2011 |
| JP | 2012-223508 | A | 11/2012 |
| JP | 5165752 | B2 | 3/2013 |
| WO | 2014002531 | A1 | 1/2014 |

OTHER PUBLICATIONS

PCT Notification Concerning Transmittal of International Preliminary Report on Patentability dated May 24, 2018 in International Application No. PCT/JP2016/083177.
International Search Report and Written Opinion dated Jan. 17, 2017 in PCT application No. PCT/JP2016/083177, and English translation of the International Search Report.

* cited by examiner

APPROPRIATE PRESSURE DETERMINATION DEVICE, APPROPRIATE PRESSURE DETERMINATION SYSTEM, AND METHOD FOR DETERMINING APPROPRIATE PRESSURE

CROSS-REFERENCE TO RELATED APPLICATION(S)

This application is a national stage application of International Patent Application No. PCT/JP2016/083177, filed Nov. 9, 2016 (WO 2017/082274 A1, published May 18, 2017), which claims priority to Japanese Patent Application No. 2015-221614, filed Nov. 11, 2015, both of which are herein incorporated by reference in their entirety.

TECHNICAL FIELD

The present document relates to muscle strengthening techniques that involve restricting the blood flow through at least one of the limbs of a subject or health promoting techniques accompanying it.

BACKGROUND ART

Muscle strength enhancement methods involving the restriction of blood flow through at least one of the limbs are known. The main mechanism of such a muscle strength enhancement method is described here. It is also known that the implementation of such a muscle strength enhancement method is effective in improving the elasticity of blood vessels and has other health promotion benefits.

In such a muscle strength enhancement method, a band is wrapped around a predetermined portion of a limb such as the proximal end of the limb, and the predetermined portion of the limb around which a band is wrapped is compressed. In the human bodies, the arteries are located closer to the center of the limbs and the veins near the surface of the limbs.

An appropriate adjustment of the limb compression using the band produces a state where the bleeding in the veins located closer to the limb surface stops and no occlusion of blood occurs in the arteries closer to the center of the limb. Thereafter, venous blood flow does not occur in the limb; however blood is supplied through the arteries to the blood vessels distal to the predetermined portion where the band is wrapped. In this state, the blood is stored in the limb distal to the predetermined portion where the band is wrapped, that is, the limb is in a so-called "congested state".

When the blood is stored in the limb distal to the predetermined portion where the band is wrapped, the oxygen supply to the muscle from the blood then decreases, resulting in muscle fatigue that leads to lactic acid accumulation in the muscle. In response to this, more than the normal amount of growth hormone is secreted from the pituitary body, enhancing muscular strength. This is how the muscle strength enhancement method involving the restriction of blood flow works.

This muscle strength enhancement method is used to strengthen the muscle by exerting a load by blood flow restriction to the muscles, and therefore has a significant characteristic with which it is possible to eliminate the requirement of exercise for muscle strengthening. Owing to this, the muscle strength enhancement method very effectively restores the motor function in individuals with abnormal motor function (e.g., elderly and injured individuals).

Another feature of this muscle strength enhancement method is that it compensates for the total amount of load applied to muscles by applying a load caused by the restriction of blood flow to the muscles; thus, when combined with exercise, the load due to exercise can be reduced. This characteristic has benefits of reducing the risk of damage to joints and muscles, allowing the training period to be shortened by reducing the need for muscle exercises to enhance muscle strength.

As described above, during this muscle strength enhancement method, it is important to compress the predetermined portion of the limb with an appropriate amount of pressure from among a range of pressures that cause vein hemostasis and do not cause arterial hemostasis (in the present application, such pressure is referred to as "appropriate pressure").

This appropriate pressure varies, depending on the person performing the muscle strength enhancement method. Further, even for one and the same individual, it also depends on proficiency of the person performing this muscle strength enhancement method as well as his/her health condition day by day. Therefore, when trying to perform this muscle strength enhancement method, it is necessary to first determine the appropriate compression pressure for the limb(s) of the individual.

Conventionally, this appropriate pressure was determined mainly by an expert with expertise, such as a doctor or a sport trainer, based on his/her past experiences; however it is convenient if the decision can be automatically made.

From such perspectives, in the field of muscle strength enhancement that involves restricting the blood flow, several methods and apparatuses for automatically determining appropriate pressures have been proposed.

Patent Documents given below disclose methods involving the determination of an appropriate pressure using a pulse wave obtained in a predetermined portion of the limb compressed with a band or somewhere distal to the predetermined portion.

As the compression on the predetermined portion of the limb with the aforementioned band gradually increases from the state of no compression, the pulse wave in the predetermined portion of the limb compressed with the band or somewhere distal to the predetermined portion progressively increases. In contrast, when the compression with the band exceeds a certain magnitude, the pulse wave then reduces. When the amplitude becomes the largest, it corresponds to a state where the arterial blood flow volume at the location where the pulse wave is measured reaches its maximum. This corresponds to the optimum condition of vein hemostasis and no arterial hemostasis.

Among the following patent documents, in the technique of Patent Document 1, the compression pressure exerted by the band when the pulse wave reaches the maximum is considered as the appropriate pressure. In addition, in the technique of Patent Document 2, when this muscle strength enhancement method involving the restriction of blood flow is used for a physically stronger person, such as an athlete in particular, rather than an ordinary individual, a compression pressure higher than that exerted by the band when the pulse wave peaks is set as the appropriate pressure for further improving the effect. In the technique of Patent Document 3, a graph of the pulse wave relative to the compression pressure is obtained wherein the pulse wave gradually increases as the compression pressure exerted by the band increases and then gradually decreases as the compression pressure exerted by the band increases after the pulse wave reaches its maximum. An inflection point is then found on the graph as a reference pressure, at a side where the compression pressure is higher than the compression pressure at which the pulse wave reaches its maximum. The inflection point is then multiplied by an appropriate number between 0 and 1, thereby obtaining the appropriate pressure.

RELATED ART DOCUMENTS

Patent Documents

[Patent Document 1] Japanese Patent No. 4839179
[Patent Document 2] Japanese Patent No. 5165752
[Patent Document 3] Japanese Patent Laid-open No. 2012-223508

SUMMARY

Problems to be Solved

However, it has increasingly been found that, in some cases, it is inappropriate to set, as an appropriate pressure, the compression pressure exerted by the band when the pulse wave is at the maximum. When the pulse wave is at the maximum, the vibration of the blood vessel becomes very large. This vibration of the blood vessel can be perceived by those performing the muscle strength enhancement method involving the restriction of blood flow, which sometimes makes them feel uneasy and fearful. As the compression pressure exerted by the band is increased until the pulse wave reaches its maximum, those performing the muscle strength enhancement method feel a progressive strengthening of their pulsation. If those who perform this muscle strength enhancement method perceive a large arterial pulsation to an extent that they don't usually feel in daily life, they naturally complain anxiety and fear. In addition, safety issues may arise if the muscle strength enhancement method is performed in such a state. This is attributable to the fact that in a state where the pulse wave is at its maximum, resonance based on the blood flow pulsation would occur in the blood vessel (or the blood vessel and its surrounding elastic tissue) compressed with the band due to the pressure (i.e., the blood pressure) exerted on the blood vessel by the blood flow, and it is anticipated that the resonance may exert excessive load on the blood vessel (or the blood vessel and surrounding elastic tissue).

Therefore, the technique of Patent Document 1, in which the compression pressure exerted by the band when the pulse wave becomes its maximum is the appropriate pressure, may cause anxiety and fear to those performing the muscle strength enhancement method, and still pose a safety issue. This also applies to the technique of Patent Document 2, in which the appropriate pressure is set as the compression pressure of the band when the pulse wave is at the maximum.

In contrast, in the case of the technique of Patent Document 3, when the number by which the reference pressure is multiplied is close to 0, the appropriate pressure may be smaller than the compression pressure of the band when the pulse wave becomes the maximum. However, even with the technique of Patent Document 3, when the number by which the reference pressure is multiplied is close to 1, the appropriate pressure may be larger than the compression pressure exerted by the band when the pulse wave becomes the maximum. In such cases, problems similar to those of Patent Documents 1 and 2 may occur. Furthermore, the technique of Patent Document 3 has further problems. The inflection point on the graph of the pulse wave used for obtaining the reference pressure in the technique of Patent Document 3 appears on the graph because the tube that is used to change the compression pressure exerted by the band by changing the pressure in the tube is made of an elastic material. As the air pressure in the tube gradually increases, the tube made of the elastic material does not stretch for a while; however, if the air pressure in the tube rises further beyond a certain level, the tube made of the elastic member starts stretching. The point at which the tube begins to stretch appears as the inflection point on the graph mentioned above. However, the stretch of the tube varies depending on certain factors such as the deterioration (deformation) of the band due to its repeated use and the environmental temperature at the time of performing the muscle strength enhancement method. Accordingly, reproducibility may be low or accuracy may be unsatisfactory in several cases. Particularly, when the inflection point moves to the side where the compression pressure is large, the appropriate pressure in Patent Document 3 is likely to be a larger value than intended.

The present embodiments solve the aforementioned problems and an object thereof is to provide a method of determining a more suitable appropriate pressure for use in muscle strength enhancement methods involving the restriction of blood flow, which is safer and less likely to cause anxiety and fear to those performing the muscle strength enhancement method.

Means to Solve the Problems

In order to solve the aforementioned problems, the present inventor proposes the following embodiments.

A present embodiment is an appropriate pressure determination device that composes an appropriate pressure determination system together with: a constricting device including: a band having a length that enables the band to be wrapped around a predetermined portion of a limb; securing means for securing the band with the band wrapped around the predetermined portion; and a gas bladder provided on or in the band, the gas bladder being for applying a predetermined compression pressure to the predetermined portion to compress the predetermined portion by being filled with a gas with the band wrapped around the predetermined portion being secured with the securing means; pressure changing means configured to set a pressure of the gas in the gas bladder to a desired pressure; and pulse wave measuring means for measuring a predetermined parameter and generating pulse wave data for the parameter near the predetermined portion or on a distal side from the predetermined portion, the predetermined parameter varying depending on a fluctuation of the magnitude of a pulse wave in an artery, the magnitude changing depending on the compression pressure.

This appropriate pressure determination device includes pressure control means for controlling the pressure changing means in order to change the compression pressure, the pressure control means being configured to control the pressure changing means so that the pressure of the gas in the gas bladder changes across and beyond a range within which a pulse wave is expected to be maximum; maximum pulse wave pressure specifying means for specifying a maximum pulse wave pressure that is a pressure of the gas in the gas bladder at a time when the pulse wave reaches its maximum by receiving the pulse wave data from the pulse wave measuring means plurality of times while the pressure in the gas bladder is changing; and appropriate pressure calculating means for obtaining an appropriate pressure smaller than the maximum pulse wave pressure by performing a predetermined calculation on the maximum pulse wave pressure.

This appropriate pressure determination device is used together with, as in conventional similar devices, a constricting device including a band, a gas bladder, and securing means, pressure changing means, such as an air pump, for changing the pressure of the gas in the gas bladder, and pulse wave measuring means for generating pulse wave data. Further, the appropriate pressure determination device includes the pressure control means for controlling the pressure changing means, and the maximum pulse wave pressure specifying means for specifying the maximum pulse wave pressure. These may be similar to those provided in conventional similar devices.

The appropriate pressure determination device also includes the appropriate pressure calculating means. This is not present in any conventional similar devices. The appropriate pressure calculating means is for obtaining an appropriate pressure that is smaller than the maximum pulse wave pressure by performing a predetermined calculation on the maximum pulse wave pressure. Accordingly, the appropriate pressure determined with this will be smaller than the maximum pulse wave pressure. Unlike the cases where the appropriate pressure is equal to or higher than the maximum pulse wave pressure, the muscle strength enhancement method involving the restriction of blood flow that is performed using this appropriate pressure is safer and can reduce anxiety and fear of those who perform the muscle strength enhancement method.

In addition, according to the study of the present inventor, it was previously considered that the appropriate pressure should be equal to or higher than the maximum pulse wave pressure, and that the effect of the muscle strength enhancement method involving the restriction of blood flow would be stronger. However, it has increasingly been found that even an appropriate pressure smaller than the maximum pulse wave pressure can provide sufficient effect if the muscle strength enhancement method involving the restriction of blood flow is used for a person with normal health status. Therefore, only slight inconvenience is caused by an appropriate pressure that is smaller than the maximum pulse wave pressure. The appropriate pressure determined according to the present embodiments can thus be commonly and widely used for ordinary people as a sort of "one-size-fits-all" appropriate pressure.

In addition, in this appropriate pressure determination device, the maximum pulse wave pressure is used to determine the appropriate pressure and the appropriate pressure is determined in a range smaller than the maximum pulse pressure. Therefore, as in the case where the inflection point on the pulse wave graph is used as described above, there is no instability such that the appropriate pressure fluctuates above and below the maximum pulse wave pressure, and resultant appropriate pressures are also accurate.

As described above, the pressure control means controls the pressure changing means in such a manner that the pressure of the gas in the gas bladder is changed with the pressure changing means. The change in the pressure of the gas in the gas bladder at this time may be continuous or stepwise. Here, "stepwise" indicates that there is a time zone in which there is no change in pressure even after a lapse of time. Further, the pressure of the gas in the gas bladder may either increase with time or decrease with time. What is required is that the pressure of the gas in the gas bladder eventually changes across and beyond a range within which a pulse wave is expected to be at maximum so that the maximum pulse wave pressure can be determined.

As described above, the pressure control means may be configured to control, prior to generating the pulse wave data, the pressure changing means in such a manner that the pressure changing means raises the pressure in the gas bladder to a pressure higher than a pressure at which the pressure is excepted to exceeds the maximum pulse wave pressure, and then reduces the pressure in the gas bladder. In this case, the pulse wave increases as the pressure is decreased, reaches its maximum, and then decreases as the pressure is decreased. In this case, the compression pressure to the limb exerted by the constricting device at a point where the pulse wave switches from increasing to decreasing is set as the maximum pulse wave pressure. In this case, it is necessary to temporarily raise the pressure of the gas in the gas bladder to a pressure higher than the pressure expected as the maximum pulse wave pressure. The expected pressure as the maximum pulse wave pressure is empirically known to fall within a certain range. Accordingly, it is substantially easy to do this. Specifically, the pressure of the gas in the gas bladder that should be temporarily increased is approximately 230-250 mmHg. However, there are individual differences as to the aforementioned pressure that should temporarily be increased to a pressure higher than the pressure expected as the maximum pulse wave pressure. Therefore, the appropriate pressure determination device can be configured to allow, in specifying the maximum pulse wave pressure, an input of the pressure of the gas in the gas bladder that needs to be raised temporarily until it reaches higher than the maximum pulse wave pressure, and to cause, by the control means receiving the input from the input means, the pressure changing means to temporarily increase the pressure of the gas in the gas bladder to the pressure based on the input.

On the other hand, as described above, the pressure control means may be configured to control, prior to generating the pulse wave data, the pressure changing means in such a manner that the pressure changing means raises the pressure in the gas bladder from a pressure expected to be lower than the maximum pulse wave pressure. In this case, the pulse wave increases as the pressure is increased, reaches its maximum, and then decreases as the pressure is increased. In such cases, the maximum pulse wave pressure appears whenever the initial pressure is set at a low level (e.g., normal pressure). Therefore, it is possible to eliminate any possibility that the maximum pulse wave pressure does not appear, which otherwise could occur when it is intended to specify the maximum pulse wave pressure while reducing the pressure. Further, this also eliminates the necessity of ensuring that "the pressure of the gas in the gas bladder that needs to be increased temporarily until it exceeds the maximum pulse wave pressure can be entered with the input means" as a way to eliminate such possibility.

The parameter that varies depending on the fluctuation of the magnitude of a pulse wave in the artery, which is measured with the pulse wave measuring means, may be related to any physical quantity. The pulse wave measuring means is, for example, a sensor which measures a surface pressure from the skin when being pressed against the skin, and may measure the surface pressure from the skin which varies depending on the pulse wave. Since the pulse wave appears as pulsation on the skin, the aforementioned pulse wave measuring means measures the surface pressure from the skin which varies depending on the pulsation as a parameter.

Alternatively, the pulse wave measuring means may be configured to measure the pressure of the gas in the gas bladder as a parameter. As described above, the pulse wave appears as pulsation on the skin. Due to the pulsation, the pressure of the air in the gas bladder of the constricting device wrapped around the limb at a location near the proximal end of the limb varies. The aforementioned pulse wave measuring means may measure the pressure of the air in the gas bladder as a parameter.

It should be noted that the pulse wave measuring means only needs to be able to measure a pulse wave near the predetermined portion of the limb or on the distal side from the predetermined portion. When the pulse wave measuring means is for measuring the pulse wave in the vicinity of the predetermined portion, the pulse wave measuring means does not necessarily measure the pulse wave on the distal side from the predetermined portion.

In the present embodiments, the appropriate pressure calculating means obtains an appropriate pressure that is smaller than the maximum pulse wave pressure by performing a predetermined calculation on the maximum pulse wave pressure. A method used for this calculation can basically be determined at discretion.

For example, the appropriate pressure may be obtained with the appropriate pressure calculating means by multiplying the maximum pulse wave pressure by a coefficient that is larger than 0 but smaller than 1. Such calculation facilitates obtaining the appropriate pressure that is smaller than the maximum pulse wave pressure. For example, in this case, the coefficient would be a number between 0.6 and 0.9. When the coefficient is 0.6, the magnitude of the pulse wave is approximately 16% smaller than the largest pulse wave (it should be noted that the contour of the pulse wave amplitude is a curve as shown in FIG. 7 and the value of 16% in this case is obtained assuming that the curve has a parabola shape of $y=-x^2$; the same applies to the below). With this magnitude of the pulse wave, it can be considered that almost no arterial hemostasis occurred and a sufficient effect in enhancing muscle strength using the muscle strength enhancement method involving the restriction of blood flow is achieved. When the coefficient is 0.9, the magnitude of the pulse wave is only approximately 1% smaller than the largest pulse wave; thus a sufficient effect is achieved as the muscle strength enhancement method. With this magnitude of the pulse wave, it can be considered that substantially no arterial hemostasis occurred. According to the studies of the present inventor, with the reduction in magnitude of the pulse wave only to this extent, it is not likely that the resonance of the blood vessels or the like described in the related art occurs. Accordingly, a coefficient that falls within the aforementioned range facilitates achieving all of the improvement of safety of the muscle strength enhancement method involving the restriction of blood flow, avoidance of fear and anxiety of a performer, and sufficient effects of the muscle strength enhancement. The coefficient would be a number between 0.7 and 0.9. When the coefficient is 0.7, the magnitude of the pulse wave is only approximately 9% smaller than the largest pulse wave. Coefficients in this range make the muscle strength enhancement method involving the restriction of blood flow more effective. When the coefficient is set at 0.7-0.85, effects in improving the safety of the muscle strength enhancement method involving the restriction of blood flow and avoiding fear and anxiety of a performer become prominent. According to the studies of the present inventor, when the coefficient is set at 0.75-0.85, it becomes easier to provide, for the largest number of people, effects in improving the safety of the muscle strength enhancement method involving the restriction of blood flow and avoiding fear and anxiety of a performer as well as sufficient effects of muscle strength enhancement. Nevertheless, considering, for example, the physical strength, age, and familiarity with the muscle strength enhancement method involving the restriction of blood flow, individuals performing the muscle strength enhancement method can be divided into, for example, two categories: for the elderly or physically weak persons, a coefficient between 0.6 and 0.75 may be used, and for persons in the other category, a coefficient between 0.75 and 0.9 may be used.

Alternatively, the appropriate pressure may be obtained with the appropriate pressure calculating means by subtracting a predetermined pressure from the maximum pulse wave pressure. By performing this calculation, an appropriate pressure that is smaller than the maximum pulse wave pressure can be obtained easily. The predetermined pressure may be 10-50 mmHg. When the predetermined pressure is within this range, the muscle strength enhancement method involving the restriction of blood flow can be performed more safely and fear and anxiety of a performer of the muscle strength enhancement method can be reduced. Besides, the effectiveness of the muscle strength enhancement method is hardly reduced.

As what exhibits effects similar to those obtained in the appropriate pressure determination device according to the present application, the present inventor also proposes the following method as an aspect of the present embodiments.

An example of this method is a method for determining an appropriate pressure performed with an appropriate pressure determination device that composes an appropriate pressure determination system together with: a constricting device including: a band having a length that enables the band to be wrapped around a predetermined portion of a limb; securing means for securing the band with the band wrapped around the predetermined portion; and a gas bladder provided on or in the band, the gas bladder being for applying a predetermined compression pressure to the predetermined portion to compress the predetermined portion by being filled with a gas with the band wrapped around the predetermined portion being secured with the securing means; pressure changing means configured to set a pressure of the gas in the gas bladder to a desired pressure; and pulse wave measuring means for measuring a predetermined parameter and generating pulse wave data for the parameter near the predetermined portion or on a distal side from the predetermined portion, the predetermined parameter varying depending on a fluctuation of the magnitude of a pulse wave in an artery, the magnitude changing depending on the compression pressure.

This method includes, in the appropriate pressure determination device, the steps of: controlling the pressure changing means in order to change the compression pressure, so that the pressure of the gas in the gas bladder is changed with the pressure changing means; specifying a maximum pulse wave pressure that is a pressure of the gas in the gas bladder at a time when the pulse wave reaches its maximum by receiving the pulse wave data from the pulse wave measuring means plurality of times while the pressure in the gas bladder is changing; and obtaining an appropriate pressure smaller than the maximum pulse wave pressure by performing a predetermined calculation on the maximum pulse wave pressure.

As what exhibits effects similar to those obtained in the appropriate pressure determination device according to the present application, the present inventor also proposes the following appropriate pressure determination system as an aspect of the present embodiments.

An example of this system is an appropriate pressure determination system including: a constricting device including: a band having a length that enables the band to be wrapped around a predetermined portion of a limb; securing means for securing the band with the band wrapped around the predetermined portion; and a gas bladder provided on or in the band, the gas bladder being for applying a predetermined compression pressure to the predetermined portion to compress the predetermined portion by being filled with a gas with the band wrapped around the predetermined portion being secured with the securing means; pressure changing means configured to set a pressure of the gas in the gas bladder to a desired pressure; pulse wave measuring means for measuring a predetermined parameter and generating pulse wave data for the parameter near the predetermined portion or on a distal side from the predetermined portion, the predetermined parameter varying depending on a fluctuation of the magnitude of a pulse wave in an artery, the magnitude changing depending on the compression pressure.

This appropriate pressure determination system further includes: pressure control means for controlling the pressure changing means in order to change the compression pressure, the pressure control means being configured to control the pressure changing means so that the pressure of the gas in the gas bladder changes; maximum pulse wave pressure specifying means for specifying a maximum pulse wave pressure that is a pressure of the gas in the gas bladder at a time when the pulse wave reaches its maximum by receiving the pulse wave data from the pulse wave measuring means plurality of times while the pressure in the gas bladder is changing; and appropriate pressure calculating means for obtaining an appropriate pressure smaller than the maximum pulse wave pressure by performing a predetermined calculation on the maximum pulse wave pressure.

The appropriate pressure determination system may be configured so as to serve as a muscle strength enhancement system by the configuration that the pressure changing means is controlled with the pressure control means so that the pressure of the gas in the gas bladder is kept at the appropriate pressure after the appropriate pressure has been determined.

As a result, the muscle strength enhancement method can be performed safely and effectively causing less anxiety and fear to those who perform the muscle strength enhancement method.

It should be noted that the number of the constricting device(s) in the appropriate pressure determination system with which the muscle strength enhancement method is performed may be either one or two or more.

In the case where two or more constricting devices are used, the number of the pulse wave measuring means is equal to the number of the constricting devices. Each of the pulse wave measuring means may be associated with the respective one of the constricting devices, and may measure a predetermined parameter that varies depending on a fluctuation of the magnitude of a pulse wave near the predetermined portion of the limb where the associated constricting device is wrapped around or on a distal side from the predetermined portion, and generate pulse wave data for the limb. In this case, the number of the pressure changing means is equal to the number of the constricting devices, and each may be associated with the respective one of the constricting devices. The maximum pulse wave pressure specifying means in this case may specify the maximum pulse wave pressure for each of the limb. The pressure control means in this case may control each of the pressure changing means associated with the constricting device for compressing the respective one of the limbs.

DETAILED DESCRIPTION

Hereinafter, with reference to the drawings, embodiments are described.

Figure 1:
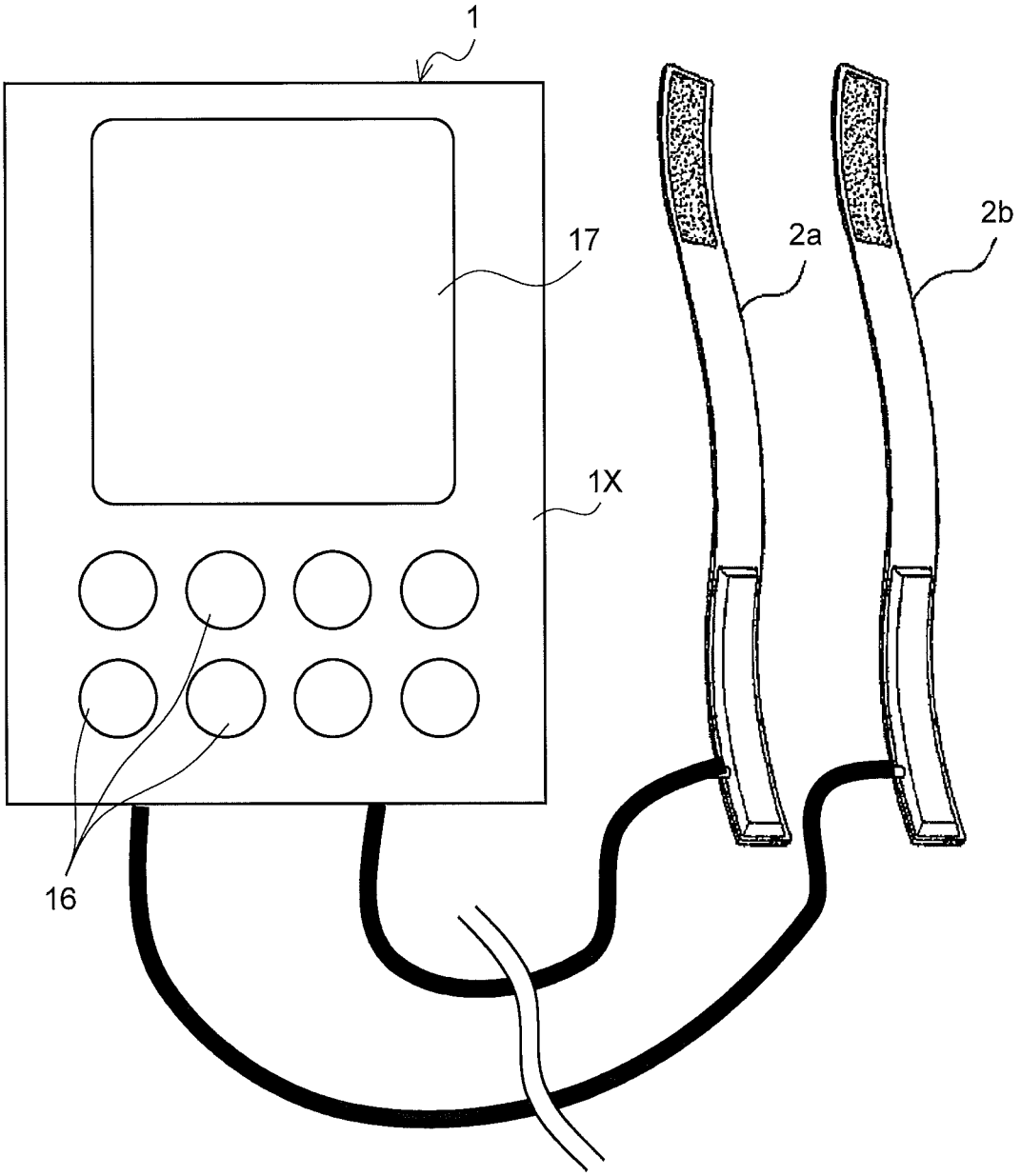
FIG. 1 is a diagram showing an overall configuration of a strength training system according to an embodiment.

FIG. 1 shows an entire strength training system according to an embodiment.

As will be described later, this strength training system executes two process operations: an appropriate pressure determination mode and a training mode. When executing the appropriate pressure determination mode, this strength training system serves as an appropriate pressure determination system defined in the present application. Also, when executing the training mode, the strength training system serves as a training system for enhancing muscle strength which involves restricting the blood flow. This strength training system may be adapted to be able to execute only the appropriate pressure determination mode.

Strength training that can be performed using the strength training system is blood flow restriction (BFR) strength training.

BFR strength training that can be achieved using this strength training system is not limited to those for the purpose of strengthening the muscular strength of healthy individuals though the term "training" is used for convenience. Instead, it may sometimes be directed to rehabilitation and other medical procedures, medical-associated actions, aesthetic treatments such as skin care, anti-aging, and diet therapies, or relaxation for mental health. Strength training that can be performed using this strength training system may be aimed at vessel strengthening in some cases. In this way, BFR strength training is effective for muscle strengthening; however, various additional benefits are provided. Even when the training is performed for such secondary benefits, it is still true that the action itself is the BFR strength training. This applies to the entire specification.

Figure 2:
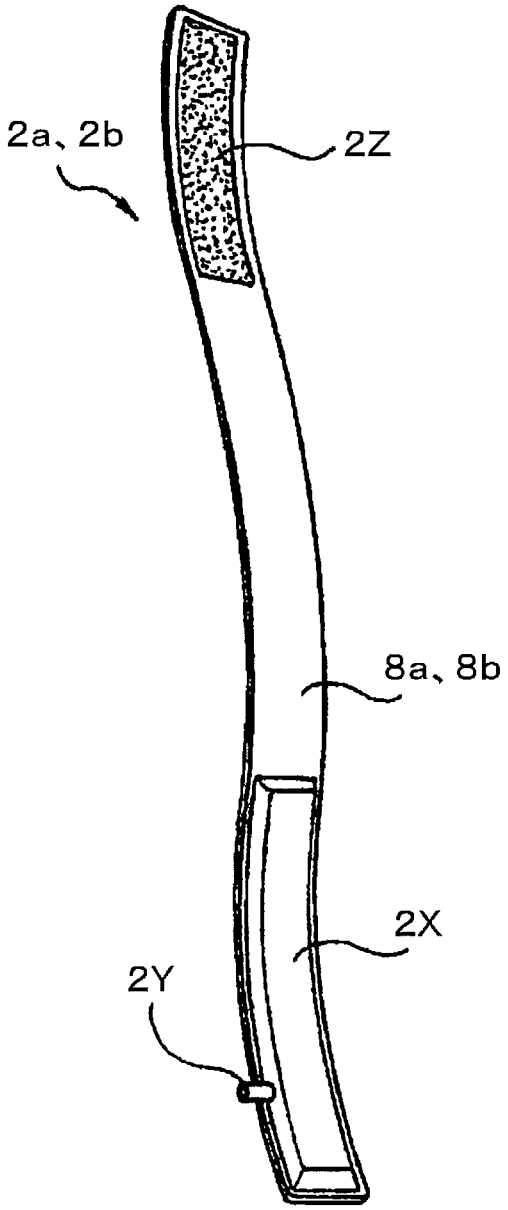
FIG. 2 is a perspective view showing a compression band included in the strength training system shown in FIG. 1.

The strength training system includes a compression pressure control device 1, and a compression band 2*a*, 2*b* shown in detail in FIG. 2.

First, a configuration of the compression bands 2*a* and 2*b* is described.

The compression bands 2*a* and 2*b* are for applying, under the control of the compression pressure control device 1, a constricting force to limbs of a subject around which they are wrapped to restrict blood flow.

Although the minimum requirement is the presence of at least one of the compression bands 2*a* and 2*b*, the strength training system of this embodiment includes a pair of compression bands 2*a* and 2*b* for the right and left arms or legs.

The compression bands 2*a* and 2*b* are provided with elongated constricting bands 8*a* and 8*b*, respectively, each having a shape of a strap. Each of the constricting bands 8*a* and 8*b* is made of a material that stretches somewhat in the lengthwise direction thereof such as neoprene rubber (although the stretch of the constricting bands 8*a* and 8*b* is not essential when, in particular, a user wearing the compression bands 2*a* and 2*b* is not expected to work out or do some exercise). The length of each band is slightly larger than the circumference of the predetermined portion of the limb, such as a predetermined portion near the top of the limb, around which it is intended to be wrapped. As to the width of the constricting bands 8*a* and 8*b*, they have an appropriate width which is narrow enough not to hit the belly when worn on a predetermined portion near the top of the limb and wide enough not to bite into the limb and give pain to the subject.

An airtight gas bladder 2X made of a material (for example, natural rubber) capable of withstanding air pressure of about 400 mmHg is attached to the inner surfaces of the constricting bands 8*a* and 8*b*. The gas bladder 2X is connected to a connection tube 2Y which is, for example, a resin tube in fluid communication with each other. The gas bladder 2X is adapted to be connected through the connection tube 2Y to the distal end of a rubber tube 3*a*, 3*b* described later of which proximal end is connected to the compression pressure control device 1.

Inside the constricting bands 8*a* and 8*b*, a securing member 2Z is provided to fix the diameter of a loop formed by the constricting band 8*a*, 8*b* when the constricting band 8*a*, 8*b* of the compression band 2*a*, 2*b* is wrapped around a predetermined portion of the limb of the subject. The securing member 2Z of this embodiment is a hook-and-loop fastener but not limited thereto. The diameter of the loop formed by the constricting band 8*a*, 8*b* is fixed by wrapping the constricting band 8*a*, 8*b* around the limb of the subject from the bottom in FIG. 2 and securing the securing member 2Z to the outer surface of the constricting band 8*a*, 8*b*.

Air is supplied to and removed from the gas bladder 2X of the compression band 2*a*, 2*b* via the rubber tube 3*a*, 3*b* by the compression pressure control device 1 with the compression band 2*a*, 2*b* fixed around an appropriate region of the limb of the subject. Due to the pressure of the air, the compression band 2*a*, 2*b* applies a constricting force at an appropriate pressure to the limb of the subject where it is worn.

The compression bands 2*a* and 2*b* can stretch somewhat in the longitudinal direction mainly because of stretchability of the constricting bands 8*a* and 8*b*. The reason for this lies in that, when the subject does some exercise with the compression bands 2*a* and 2*b* worn on his/her limbs and bends the joints, the muscles of the limbs become thick, and therefore if the compression bands 2*a* and 2*b* do not have any stretchability, the constricting force applied by the compression bands 2*a* and 2*b* to the limbs becomes excessive.

Next, the compression pressure control device 1 is described.

Figure 3:
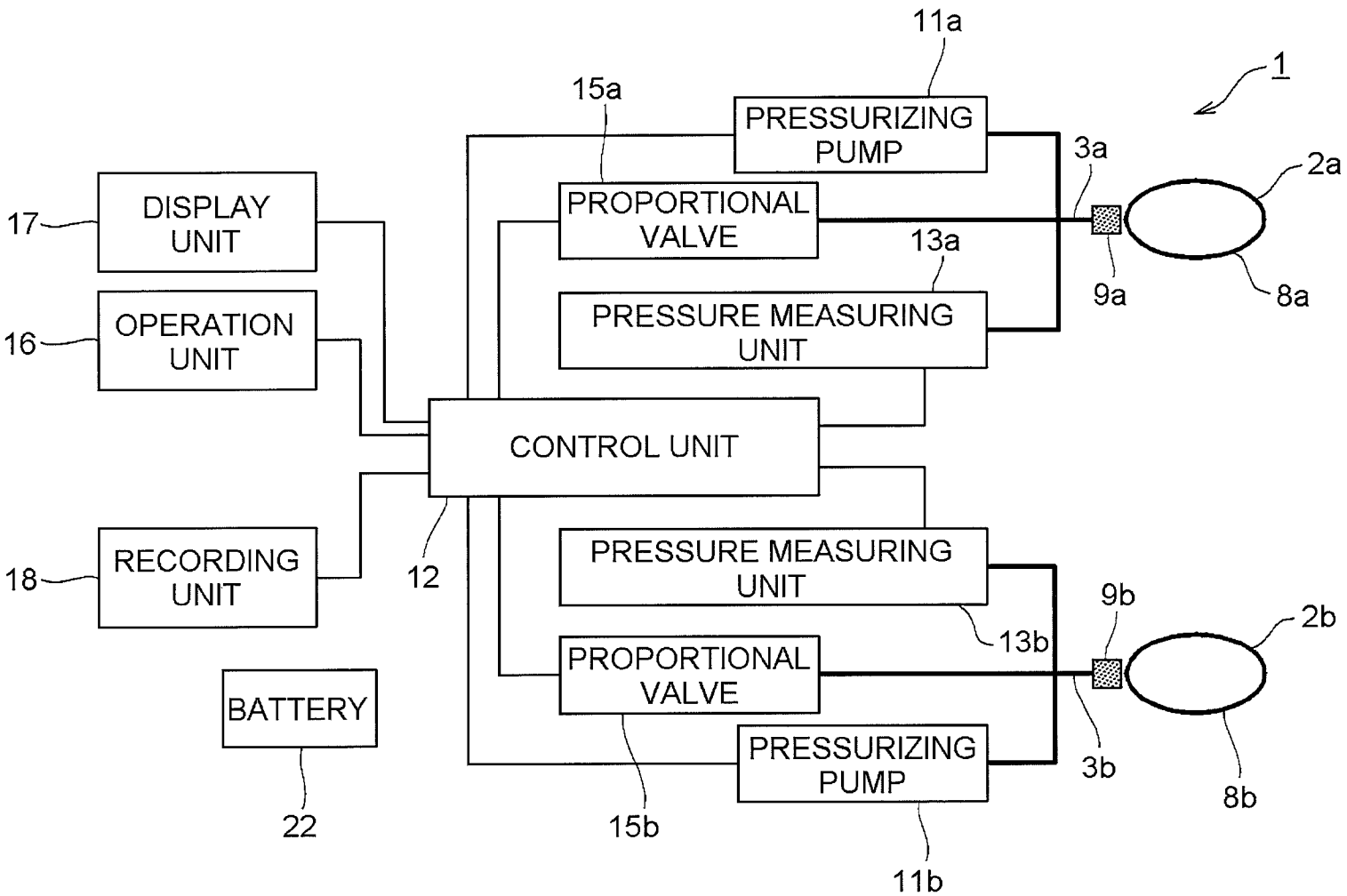
FIG. 3 is a hardware configuration diagram of a compression pressure control device included in the muscle strength enhancement system shown in FIG. 1.
Figure 4:
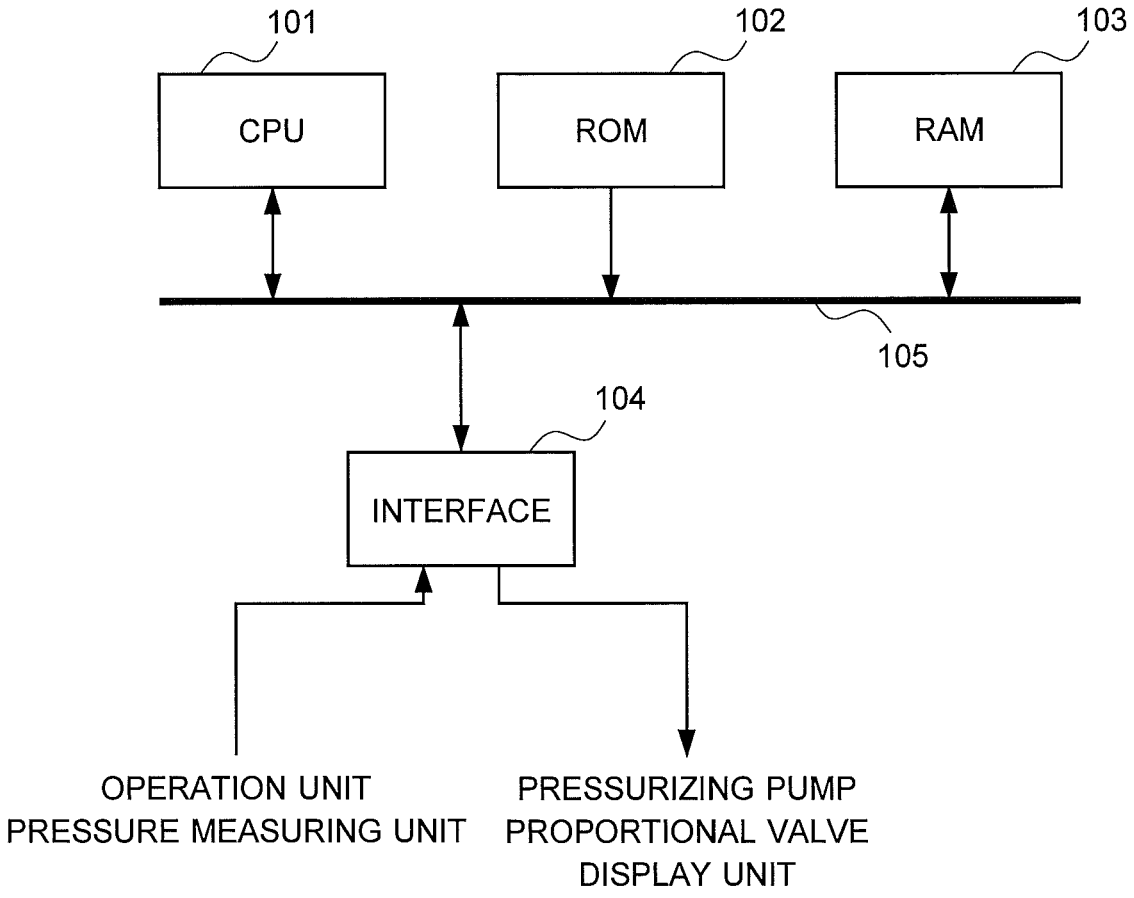
FIG. 4 is a diagram showing a hardware configuration of a control unit included in the compression pressure control device included in the muscle strength enhancement system shown in FIG. 1.

A specific configuration of the compression pressure control device 1 is shown in FIGS. 1, 3, and 4.

The compression pressure control device 1 has a function of feeding air into the gas bladders 2X of the compression bands 2*a* and 2*b* wrapped around the limbs of the subject and causing the compression bands 2*a* and 2*b* to compress the limbs of the subject. With this, the compression pressure control device 1 can allow the subject to perform BFR training. The compression pressure control device 1 is also adapted to be capable of determining an appropriate pressure, which is an appropriate compression pressure to be applied by the compression bands 2*a* and 2*b* to the limbs of the subject when the subject performs BRF training.

As can be seen from the above, the compression pressure control device 1 is adapted to execute two modes: a training mode just for BFR training and an appropriate pressure determination mode for determining an appropriate pressure.

The compression pressure control device 1 of this embodiment is constituted by attaching various components to a casing 1X or incorporating it therein, though not necessarily limited thereto.

The casing 1X of the compression pressure control device 1 is provided with an operation unit 16 in an appropriate form such as a button and a dial. The operation unit 16 is for generating data when it is operated. The operation unit 16 is connected to a control unit 12 so that necessary data can be supplied to the control unit 12. By operating the operation unit 16, it is possible to enter: data on set pressure for adjusting compression forces applied by the compression bands 2*a* and 2*b*, data used to cause the control unit 12 to execute mode shifting for starting and ending the appropriate pressure determination mode described later for automatically measuring an appropriate pressure suitable for each subject, and data for starting (turning on) or stopping (turning off) a compressing operation of the compression bands 2*a* and 2*b*.

The casing 1X is provided with a display unit 17. The display unit 17 is for displaying characters or images, and is composed of, for example, an LCD (liquid crystal display). Displayed on the display unit 17 are, for example, what has been entered through the operation of the operation unit 16; the appropriate pressure described later; a pressure display that displays the pressure applied to the limbs of a subject by the compression bands 2*a* and 2*b*; and a timer display that displays a compression time. The display unit 17 is adapted to display appropriate things in addition to those mentioned above based on the data generated by the control unit 12 described later.

As described above, the compression pressure control device 1 is adapted to be attached with the compression band 2*a*, 2*b* which is intended to be wrapped around at least one of the limbs of the subject, as shown in FIG. 3.

The compression bands 2*a* and 2*b* are adapted to be connected to the compression pressure control device 1 when necessary, via the rubber tubes 3*a* and 3*b*, respectively, which are tubes as connecting members. The number of the rubber tubes 3*a* and 3*b* required is equal to the number of the compression bands 2*a* and 2*b*, and in this embodiment, there are two rubber tubes 3*a* and 3*b*. The rubber tube 3*a*, 3*b* is connected to the gas bladder 2X of the compression band 2*a*, 2*b* through the connection tube 2Y at one end of the rubber tube 3*a*, 3*b*. The rubber tube 3*a*, 3*b* is also connected to the compression pressure control device 1 at the other end thereof. Valve-equipped couplers 9*a* and 9*b* are attached to the tip of the rubber tubes 3*a* and 3*b*, respectively, and the gas bladders 2X of the compression bands 2*a* and 2*b* are connected to the valve-equipped couplers 9*a* and 9*b*, respectively.

The compression pressure control device 1 includes, as shown in FIG. 3, pressurizing pumps 11*a* and 11*b*. Each of the pressurizing pumps 11*a* and 11*b* is an air pump. The pressurizing pumps 11*a* and 11*b* are connected to the rubber tubes 3*a* and 3*b* that are connected to the compression bands 2*a* and 2*b*, respectively, in the above-described manner. The pressurizing pumps 11*a* and 11*b* are adapted to supply air to the rubber tubes 3*a* and 3*b* under individual control to supply the air to the gas bladder 2X of each of the compression bands 2*a* and 2*b*.

The compression pressure control device 1 also includes pressure measuring units 13*a* and 13*b*. The pressure measuring units 13*a* and 13*b* are sensors capable of measuring the pressure of a gas. The pressure measuring units 13*a* and 13*b* indirectly measure the pressure in the gas bladders 2X by measuring the air pressure in the rubber tubes 3*a* and 3*b*, respectively, thereby indirectly measure the pressure applied to the limbs of the subject by the compression bands 2*a* and 2*b* at that time. The pressure measuring units 13*a* and 13*b* of this embodiment are adapted to be connected to, but not limited to, the branch tubes branched from the rubber tubes 3*a* and 3*b*, respectively, to measure the air pressure in the branch tubes. The pressure measuring units 13*a* and 13*b* are adapted to generate pressure data that is data on the measured air pressure.

The pressure measuring units 13*a* and 13*b* are also connected to the control unit 12 described later. The pressure data generated by the pressure measuring units 13*a* and 13*b* are sent to the control unit 12. The control unit 12 uses the pressure data for controlling the pressurizing pumps 11*a* and 11*b* described later. In addition, the control unit 12 detects a pulse wave of the subject from the pressure data.

The compression pressure control device 1 also includes the control unit 12. The control unit 12 is a computer and governs the control of the entire compression pressure control device 1. For example, the control unit 12 controls the driving of the pressurizing pumps 11*a* and 11*b*. In addition, the control unit 12 determines an appropriate pressure and generates data on the appropriate pressure in a manner described later.

The control unit 12 of the compression pressure control device 1 includes hardware components shown in FIG. 4. The hardware components in the control unit 12 are: a CPU 101 that is an arithmetic unit, a ROM 102 that stores a program that determines a process to be executed by the CPU 101 and data necessary for executing the program, a RAM 103 that provides a work space for CPU 101 to execute programs, and an interface 104 that connects an external device and the CPU 101 and the like. Further, the CPU 101, the ROM 102, the RAM 103, and the interface 104 are connected with each other via a bus 105. The programs and data stored on the ROM 102 include at least a computer program and data necessary for generating functional blocks described later inside the control unit 12. Such a computer may generate functional blocks (described later) by itself, or may generate functional blocks in cooperation with other program(s). Various data are recorded on the RAM 103, but the function of the RAM 103 may be shared by a recording unit 18 described later. The interface 104 is connected to pressure measuring units 13*a* and 13*b*, the pressurizing pumps 11*a* and 11*b*, proportional valves 15*a* and 15*b* (described later), the operation unit 16, the display unit 17, and the recording unit 18 (described later).

Figure 5:
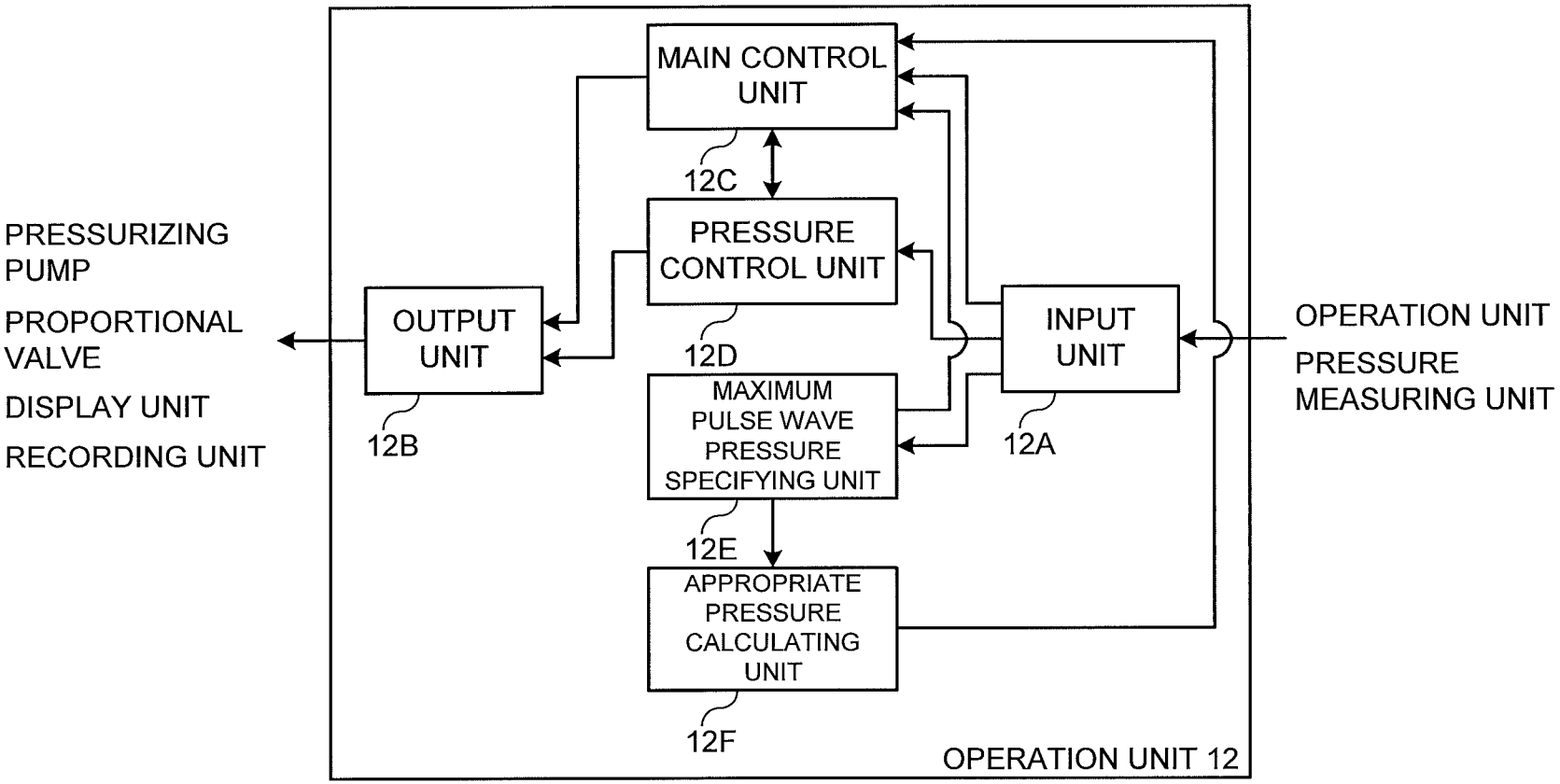
FIG. 5 is a block diagram showing functional blocks formed in the control unit.

By executing the aforementioned program, functional blocks as shown in FIG. 5 is generated in the control unit 12.

The functional blocks to be generated are an input unit 12A, an output unit 12B, a main control unit 12C, a pressure control unit 12D, a maximum pulse wave pressure specifying unit 12E, and an appropriate pressure calculating unit 12F.

The input unit 12A receives data input from the outside to the control unit 12. The input unit 12A is adapted to send the received data to an appropriate functional block or blocks. For example, the input unit 12A is adapted to receive data input from the operation unit 16 and to send it to the main control unit 12C. The input unit 12A is also adapted to receive pressure data from the pressure measuring units 13*a* and 13*b* and to send them to the pressure control unit 12D and the maximum pulse wave pressure specifying unit 12E.

The main control unit 12C controls the entire compression pressure control device 1. The main control unit 12C performs such control based on the data input from the operation unit 16. Such control performed by the operation unit 16 is ON/OFF switching of the power supply of the compression pressure control device 1 and switching between the appropriate pressure determination mode and the training mode described later. Further, when starting either the appropriate pressure determination mode or the training mode, the main control unit 12C sends the data indicating that to the pressure control unit 12D. As will be described later, the main control unit 12C is adapted to receive appropriate pressure data from the appropriate pressure calculating unit 12F. In addition, the main control unit 12C is adapted to generate image data of an image including characters to be displayed on the display unit 17, and to send it to the output unit 12B. The main control unit 12C is adapted to send the appropriate pressure data to the recording unit 18 via the output unit 12B as described later and is also adapted to send it to the pressure control unit 12D.

By controlling the pressurizing pumps 11*a* and 11*b*, the pressure control unit 12D controls the air pressure in the gas bladders 2X provided on or in the compression bands 2*a* and 2*b*, whereby controls the pressure applied to the limbs of the subject by the compression bands 2*a* and 2*b*. In order to make this possible, the pressure control unit 12D is adapted to monitor the air pressure in the gas bladders 2X provided on or in the compression bands 2*a* and 2*b* at that point in time in substantially real time, based on the pressure data received from the input unit 12A. The pressure control unit 12D includes a timer which is not shown, and is adapted to generate first control data for controlling the pressurizing pumps 11*a* and 11*b*, which is data calculated or set in accordance with the time measured by the timer. The pressure control unit 12D receives the appropriate pressure data from the main control unit 12C as described above, which is also used for generating the first control data. The pressurizing pumps 11*a* and 11*b* which have received the first control data as described later are driven so as to appropriately change or maintain the air pressure in the gas bladders 2X according to an instruction by the first control data. Further, the pressure control unit 12D is adapted to generate second control data for controlling proportional valves 15*a* and 15*b* described later. The proportional valves 15*a* and 15*b* which have received the second control data as described later are driven according to an instruction by the second control data as described later. The pressure control unit 12D is adapted to send the generated first and second control data to the output unit 12B. Details of how to generate the first and second control data are described later.

The maximum pulse wave pressure specifying unit 12E is for specifying the maximum pulse wave. The maximum pulse wave pressure specifying unit 12E is adapted to receive pressure data from the input unit 12A. The maximum pulse wave pressure specifying unit 12E is adapted to: detect a pulse wave therefrom; further detect the timing at which the pulse wave reaches its maximum from the detected pulse wave; and the maximum pulse wave pressure which is the air pressure in the gas bladder 2X when the pulse wave reaches its maximum. How to detect the timing when the pulse wave reaches its maximum is described in detail later. Once the maximum pulse wave pressure is specified, the maximum pulse wave pressure specifying unit 12E generates maximum pulse wave pressure data representing the maximum pulse wave pressure, and sends the maximum pulse wave pressure data to the appropriate pressure calculating unit 12F.

The appropriate pressure calculating unit 12F is for determining an appropriate pressure. As described above, the appropriate pressure calculating unit 12F receives the maximum pulse wave pressure data from the maximum pulse wave pressure specifying unit 12E. The appropriate pressure calculating unit 12F determines an appropriate pressure by performing a predetermined calculation on the maximum pulse wave pressure indicated by the maximum pulse wave pressure data. Once the appropriate pressure is determined, the appropriate pressure calculating unit 12F generates appropriate pressure data representing the appropriate pressure. The appropriate pressure data is sent from the appropriate pressure calculating unit 12F to the main control unit 12C.

The output unit 12B is for supplying data from the control unit 12 to the outside. The output unit 12B is adapted to send the received data to an appropriate device or devices external to the control unit 12.

As described above, the output unit 12B may receive image data from the main control unit 12C. The output unit 12B is adapted to send the received image data to the display unit 17. In response to the reception of the image data, the display unit 17 displays an image based on the image data. The output unit 12B may also receive the first control data and the second control data from the pressure control unit 12D. When receiving the first control data, the output unit 12B sends it to the pressurizing pumps 11*a* and 11*b*. When receiving the second control data, the output unit 12B sends it to the proportional valves 15*a* and 15*b*. The pressurizing pumps 11*a* and 11*b* are configured to be driven according to the first control data when they receive it. The proportional valves 15*a* and 15*b* are configured to be driven according to the second control data when they receive it.

The output unit 12B may receive the appropriate pressure data from the main control unit 12B. In response to the reception of the appropriate pressure data, the output unit 12B sends it to the recording unit 18.

The compression pressure control device 1 also includes the proportional valves 15*a* and 15*b*. The proportional valves 15*a* and 15*b* are control valves that can proportionally adjust the pressure in the rubber tubes 3*a* and 3*b*, respectively. The proportional valves 15*a* and 15*b* serve to keep the pressure exerted on the compression bands 2*a* and 2*b* constant by PID control even when the subject performs some exercise and the cross-sectional area of the muscles is fluctuated. The proportional valves 15*a* and 15*b* of the present embodiment are configured to, but not necessarily limited to, be connected to branch tubes branched from the rubber tubes 3*a* and 3*b* on their proximal sides which are different from those connected to the pressure measuring units 13*a* and 13*b* to adjust the pressure of the air in the branch tubes.

The proportional valves 15*a* and 15*b* are connected to the control unit 12, and their opening/closing is controlled by the data from the control unit 12.

Furthermore, the control unit 12 is connected to the recording unit 18 which is a memory. On the recording unit 18, in addition to the aforementioned appropriate pressure data, temporary records of a history of operations performed in the operation unit 16, a history of abnormality occurrences, and analysis data in an automatic measurement mode for automatically measuring an appropriate pressure of a subject as well as clock data. Such recording is performed by the control unit 12.

Further, the compression pressure control device 1 is provided with a battery 22 for driving the control unit 12, the pressure measuring units 13*a* and 13*b*, the proportional valves 15*a* and 15*b*, the operation unit 16, the display unit 17, the recording unit 18 and the others which constitute the compression pressure control device 1.

Next, a method of using this strength training system and its operation are described.

First, a power switch included in the operation unit 16 of the compression pressure control device 1 is operated to turn on the power supply to activate the compression pressure control device 1. The data input from the operation unit 16 is sent to the main control unit 12C via the input unit 12A. The main control unit 12C receiving this data turns on the power supply of the compression pressure control device 1.

At the time of activation setting, the setting of the compression pressure control device 1 at the time of activation is displayed on the display unit 17, and an indication prompting an expert (hereinafter, also referred to as an "instructor") who has knowledge and skills about BFR training and who assists the subject, to determine whether or not the mode should be shifted to the appropriate pressure determination mode is displayed on the display unit 17. Such display is made based on the image data generated by the main control unit 12C in the control unit 12 and sent to the display unit 17 via the output unit 12B.

The instructor selects whether to start the appropriate pressure determination mode after looking at the display on the display unit 17. This selection is made by operating the operation unit 16. The appropriate pressure determination mode is a mode for determining the appropriate pressure as described above. If the instructor did not select a transition to the appropriate pressure determination mode, the compression pressure control device 1 executes the training mode for simply performing BFR training.

If appropriate pressure data for a subject generated as described later is recorded on the recording unit 18, the instructor may use that appropriate pressure data to instruct the compression pressure control device 1 to let the subject perform BFR training. On the other hand, even if the appropriate pressure data previously generated is recorded on the recording unit 18, in the case where the instructor determines that the appropriate pressure should be calculated and set again such as when there is a change in health conditions of the subject or when the subject requests BRF training of a higher or lower level, the instructor operates the operation unit 16 to shift the mode to the appropriate pressure determination mode to cause the compression pressure control device 1 to execute the appropriate pressure determination mode.

Hereinafter, the explanation is continued on the assumption that the appropriate pressure determination mode is selected.

When the appropriate pressure determination mode is executed, the instructor operates the operation unit 16 to select the target to be constricted by the compression band 2*a*, 2*b* from "arm" and "leg" and enters the selection by operating the operation unit 16. In addition, the instructor lets the subject wear the compression band 2*a*, 2*b* on either his/her "arm" or "leg," wrapping around the selected site at an appropriate position near the proximal end of the arm or the leg. The data generated by the instructor's operating the operation unit 16 when the appropriate pressure determination mode is selected is sent to the main control unit 12C via the input unit 12A. In response to this, the main control unit 12C sends, to the pressure control unit 12D, in order to execute the appropriate pressure determination mode, a command to start the appropriate pressure determination mode along with the data that represents on which the "arm" and "leg" the appropriate pressure determination mode is performed.

In this state, the instructor operates the operation unit 16 and enters data for driving the pressurizing pump 11*a*, 11*b*. This data is also sent from the operation unit 16 to the pressure control unit 12D via the input unit 12A and the main control unit 12C. The pressure control unit 12D generates the first control data on the basis of them. The generated first control data is sent to the pressurizing pump 11*a*, 11*b* via the output unit 12B, and the pressurizing pump 11*a*, 11*b* is driven. Under the control of the control unit 12, the pressurizing pump 11*a*, 11*b* supplies air to the gas bladder 2X of the compression band 2*a*, 2*b* to apply a pressure of about 10 mmHg to 15 mmHg such as about 13 mmHg to the compression band 2*a*, 2*b*.

In this state, the instructor adjusts the compression to the predetermined portion of the limb of the subject achieved by the compression band 2*a*, 2*b* worn thereon so that the compression force applied to the limb of the subject by the compression band 2*a*, 2*b* is held at a predetermined wearing pressure of, for example, about 40 mmHg. The wearing pressure is an initial pressure applied to the limb of the subject by the compression band 2*a*, 2*b* and is a zero-reference of the pressure to be applied to the limb of the subject by the compression band 2*a*, 2*b* due to subsequent fluctuations in the air pressure in the gas bladder 2X.

By such adjustment, the constricting pressure or force applied by the compression band 2*a*, 2*b* to the limb of the subject is as expected.

The aforementioned check of the pressure is performed by causing the pressure control unit 12D that has received the pressure data generated by the pressure measuring unit 13*a*, 13*b* via the input unit 12A to monitor the air pressure in the gas bladder 2X provided on or in the compression band 2*a*, 2*b* at that point in time in substantially real time. The pressure control unit 12D sends information indicating the air pressure in the gas bladder 2X at that point in time to the main control unit 12C and the main control unit 12C causes the display unit 17 to display a numerical value indicating the air pressure in the gas bladder 2X at that point in time by sending the image data generated by it to the display unit 17 via the output unit 12B. The instructor can grasp the air pressure in the gas bladder 2X at that point in time by looking at the display on the display unit 17. It is to be noted that the monitor of the air pressure in the gas bladder 2X provided on or in the compression band 2*a*, 2*b* described above in substantially real time and the display of the numerical value indicating the pressure of the air in the gas bladder 2X on the display unit 17 are continued, but not limited to, not only during the appropriate pressure determination mode but also during the training mode performed by the compression pressure control device 1 in this embodiment.

At this time, when the compression force of the compression band 2*a*, 2*b* measured by the pressure measuring unit 13*a*, 13*b* becomes larger than a predetermined compression force of, for example, 80 mmHg, in the control unit 12, the pressure control unit 12D notifies the main control unit 12C of it, and the main control unit 12C which has received the notification sends image data to the display unit 17 indicating the compression force is abnormal and causes the display unit 17 to display warning.

In this case, the instructor adjusts the compression by the compression band 2*a*, 2*b* again.

Next, as a warming-up operation, the operation unit 16 is operated to gradually adjust the compression force of the compression band 2*a*, 2*b*. At this time, when the compression band 2*a*, 2*b* is worn on the arm, a pressure lower by 30 mmHg than the compression force presumed to be the appropriate pressure for the subject from the experience of the instructor is determined as a compression force at the first stage. A pressure obtained by adding a pressure of about 10 mmHg to the compression force at the first stage is determined as a compression force at the second stage. A pressure obtained by adding a pressure of about 10 mmHg to the compression force at the second stage is determined as a compression force at the third stage. The pressure is thus gradually increased. In this case, the pressure can be automatically set according to the data recorded on the recording unit 18, but it can also be set manually by the instructor by operating the operation unit 16. In this embodiment, the instructor manually performs such an operation, but not limited thereto. In accordance with the input from the operation unit 16 made by the instructor, the pressure control unit 12D controls the pressurizing pumps 11*a* and 11*b*. When the compression force at each stage is exerted on the compression band 2*a*, 2*b*, the subject is instructed to flex his/her arm at the elbow.

On the other hand, when the compression band 2*a*, 2*b* is worn on the leg, a pressure that is lower by 60 mmHg than the compression force presumed to be the appropriate pressure for the subject is determined as a compression force at the first stage. A pressure obtained by adding a pressure of about 20 mmHg to the compression force at the first stage is determined as a compression force at the second stage. A pressure obtained by adding a pressure of about 20 mmHg to the compression force at the second stage is determined as a compression force at the third stage. The pressure is thus gradually increased. When the compression force at each stage is exerted on the compression band 2*a*, 2*b*, the subject is instructed to flex his/her leg at the knee.

Next, the instructor operates the operation unit 16 to start the appropriate pressure determination mode.

When the appropriate pressure determination mode is started, the pressure control unit 12D generates the first control data in accordance with an instruction from the main control unit 12C. The first control data is sent from the pressure control unit 12D to the pressurizing pump 11*a*, 11*b* via the output unit 12B, and the pressurizing pump 11*a*, 11*b* is driven in accordance with the instruction by the first control data.

While the appropriate pressure determination mode is being executed, the pressurizing pump 11*a*, 11*b* changes the air pressure in the gas bladder 2X so that the pressure of the pressurizing pump 11*a*, 11*b* changes across a presumed appropriate pressure. To change the air pressure, two ways are available: the air pressure is gradually increased from a low pressure and finally to exceed the presumed appropriate pressure; and the air pressure is increased to a pressure that is higher than the presumed appropriate pressure and then reduced to a pressure that is lower than the presumed appropriate pressure. Although either can be used, this embodiment uses the latter.

By the pressurizing pump 11*a*, 11*b*, air is supplied to the gas bladder 2X, and a predetermined pressure that is higher than the presumed appropriate pressure is exerted on the compression band 2*a*, 2*b*. The predetermined compression force that is greater than the presumed appropriate pressure can be, for example, a pressure at which hemostasis occurs in the limb of the subject receiving that pressure (i.e., hemostatic pressure), and this embodiment holds it. In this embodiment, the pressure is first increased until the air pressure in the gas bladder 2X reaches 380 mmHg at which hemostasis occurs in most subjects. This pressure is entered by the instructor by operating the operation unit 16, which is not necessarily so.

It should be noted that the presumed appropriate pressure is determined based on the knowledge and experiences of an instructor, but is not absolute. A pressure that is higher than the presumed appropriate pressure can be automatically determined by the compression pressure control device 1 in a manner described later. In this case, by operating the operation unit 16, the pressurizing pump 11*a*, 11*b* of the compression pressure control device 1 is driven to increase the pressure to a predetermined pressure (e.g., 60 mmHg). This pressure is maintained for a predetermined time (e.g., about 10 seconds), during which amplitudes of the pulse wave are measured and an average thereof is calculated. Then, the pressure is released. Subsequently, the pressurizing pump 11*a*, 11*b* is driven to increase the pressure to 80 mmHg that is somewhat (e.g., 20 mmHg) higher than the last pressure. This pressure is maintained for a predetermined time, during which amplitudes of the pulse wave are measured and an average thereof is calculated. Then, the pressure is released. Thereafter, similar operations are repeated every time when the pressure is increased by a certain amount (e.g., 20 mmHg) compared to the pressure immediately before. If the average value of the pulse wave amplitudes becomes smaller than the average value of pulse wave amplitudes at the time of previous operation, or the average stopped changing, the pressure used at that time or a pressure that is slightly higher than that pressure (e.g., 1.1 to 1.2 times the pressure used at that time) can be determined as a pressure that is higher than the presumed appropriate pressure.

After the air pressure in the gas bladder 2X of the compression band 2*a*, 2*b* is increased to a pressure that is higher than the appropriate pressure, the operation of the pressurizing pump 11*a*, 11*b* is stopped and the proportional valve 15*a*, 15*b* is opened to gradually reduce the compression force exerted on the compression band 2*a*, 2*b* to a pressure that is definitely smaller than the presumed appropriate pressure such as 20 mmHg. This operation can be achieved in response to an input to perform this operation made by an instructor via the operation unit 16 to the control unit 12. However, in this embodiment, when the pressure in the gas bladder 2X reaches 380 mmHg, this operation is performed automatically in response to the transmittance of data by the control unit 12 to the pressurizing pump 11*a*, 11*b* and the proportional valve 15*a*, 15*b*. More specifically, the pressure control unit 12D which generated the second control data in accordance with an instruction from the main control unit 12C sends the second control data to the proportional valve 15*a*, 15*b* via the output unit 12B. The proportional valve 15*a*, 15*b* receives the second control data, and performs the aforementioned operation based thereon.

Figure 6:
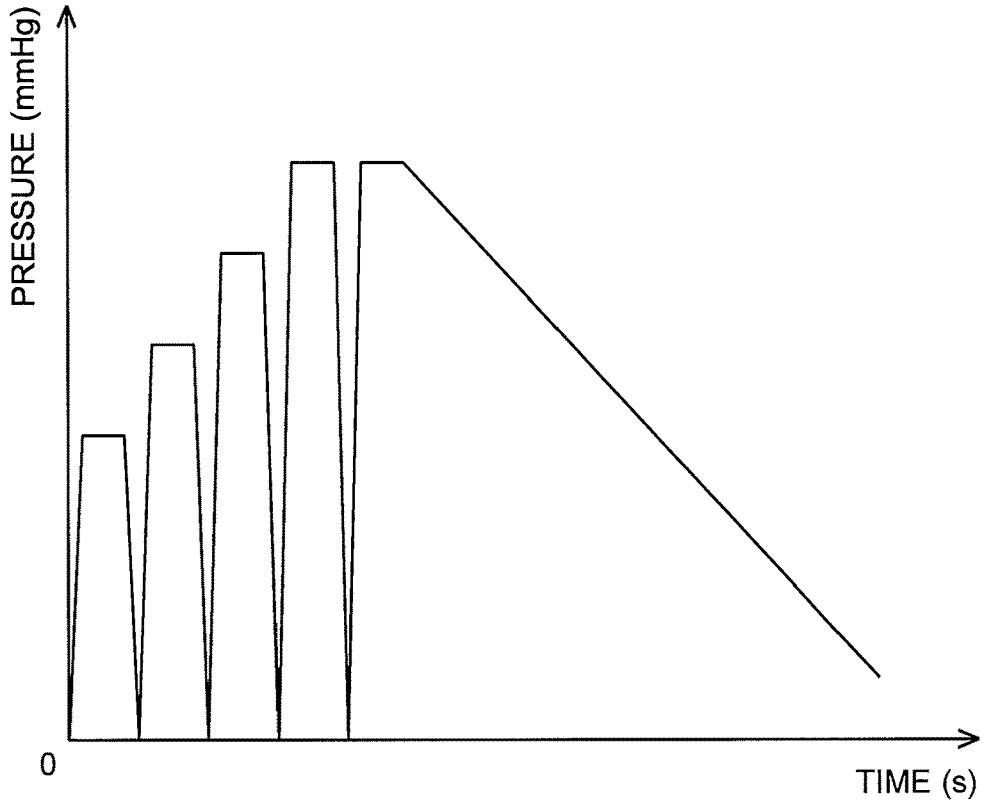
FIG. 6 is a timing chart for the pressure of the air in a gas bladder when an appropriate pressure is determined by the compression pressure control device.

Just for reference, FIG. 6 shows a timing chart for pressure change during the step of automatically determining the presumed appropriate pressure and the subsequent step of reducing the air pressure in the gas bladder 2X of the compression band 2*a*, 2*b*.

While the pressure in the gas bladder 2X goes down, the pressure measuring unit 13*a*, 13*b* measures the air pressure in the gas bladder 2X, and generates pressure data.

The generated pressure data is sent to the maximum pulse wave pressure specifying unit 12E. For the pressure data, data of a very small fluctuation of the air pressure caused by the amplitude of the pulse wave of the subject is added to data of large fluctuation of air pressure caused by the supply or removal of the air to and from the gas bladder 2X by the pressurizing pump 11*a*, 11*b* or exercise of the subject.

Figure 7:
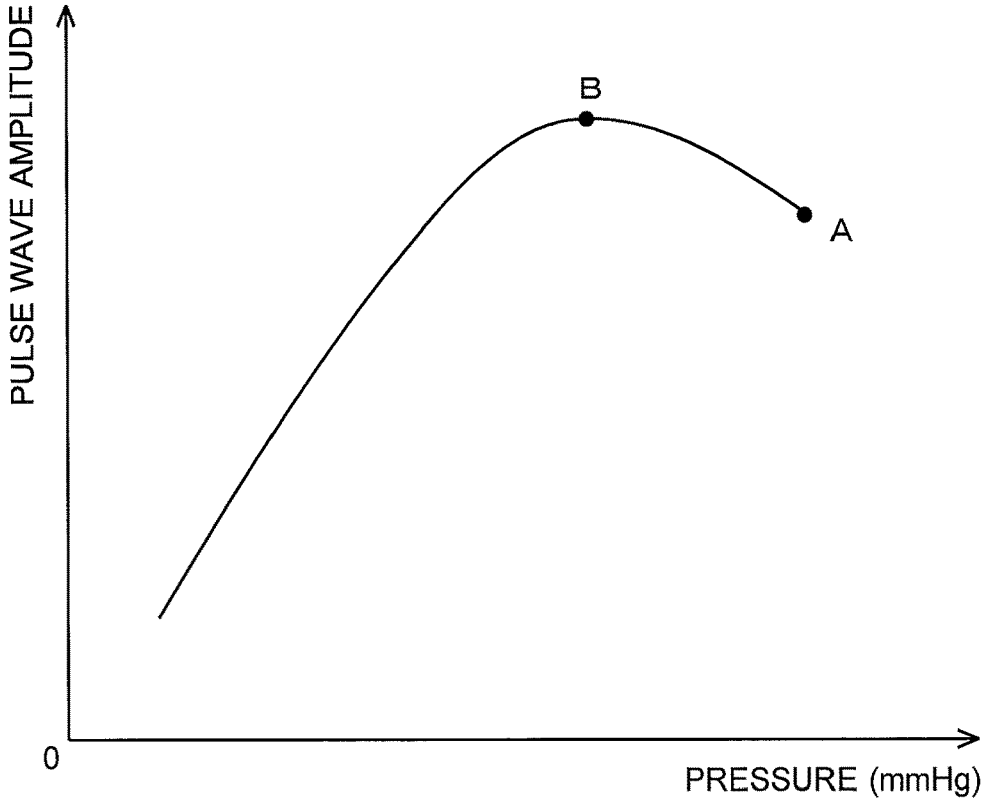
FIG. 7 is a view for explaining how to determine the maximum pulse wave pressure to be executed in the compression pressure control device shown in FIG. 1.

The maximum pulse wave pressure specifying unit 12E which has received the pressure data separates the data of the air pressure based on the pulse wave amplitude from the pressure data to generate pulse wave data about the pulse wave amplitude. Then, a graph is plotted for pulse wave amplitude (Y) represented by the separated pulse wave data as a function of the air pressure (X) in the gas bladder 2X. This graph corresponds is an amplitude curve. An example of the amplitude curve is shown in FIG. 7.

The amplitude curve is actually started from the point A. When the pressure of the air in the gas bladder 2X is reduced, the trajectory is plotted from the point A to the left through the point B. The pulse wave amplitude represented by the amplitude curve increases as the pressure is reduced in the case where the pressure of the air in the gas bladder 2X is higher than the appropriate pressure. When the pressure of the air in the gas bladder 2X becomes lower than the appropriate pressure, the pulse wave amplitude reaches its maximum at the point B in FIG. 7 where the pulse wave amplitude decreases as the pressure is reduced. The pressure of the air in the gas bladder 2X at that time is specified as the maximum pulse wave pressure with the maximum pulse wave pressure specifying unit 12E.

In this embodiment, since the pulse wave is measured based on the pressure of the air in the gas bladder 2X provided on or in the compression band 2*a*, 2*b*, the pulse wave at the position where the limb on which the compression band 2*a*, 2*b* is worn is compressed with the compression band 2*a*, 2*b* is measured. However, the position where the pulse wave is measured is not limited thereto, and may be another position of the limb near the position where the compression band 2*a*, 2*b* is secured or distal to the compressed portion. Further, in this embodiment, the pulse wave is detected based on the fluctuation of the pressure of the air in the gas bladder 2X provided on or in the compression band 2*a*, 2*b*; however, a parameter used for detecting the pulse wave is not limited to the pressure of the air in the gas bladder 2X. For example, it is possible to measure a pulse wave by illuminating a fingertip with the light using a typical pulse wave sensor, photoplethysmogram.

When the maximum pulse wave pressure is specified, the maximum pulse wave pressure specifying unit 12E generates the maximum pulse wave pressure data representing the maximum pulse wave pressure, and sends it to the appropriate pressure calculating unit 12F.

The appropriate pressure calculating unit 12F performs calculation on the maximum pulse wave pressure represented by the maximum pulse wave pressure data to determine the appropriate pressure. The calculation performed with the appropriate pressure calculating unit 12F is such that the appropriate pressure becomes smaller than the maximum pulse wave pressure.

Such calculation can be said as, for example, an operation of multiplying the maximum pulse wave pressure by a coefficient that is larger than 0 but smaller than 1. The coefficient would be a number between 0.6 and 0.9. The coefficient can also be a number between 0.7 and 0.9; more preferably, it can be a number between 0.7 and 0.85. When the coefficient is set at 0.75-0.85, it becomes easier to provide, for the largest number of people, effects in improving the safety of the muscle strength enhancement method involving the restriction of blood flow and avoiding fear and anxiety of a performer as well as sufficient effects of muscle strength enhancement. The coefficients mentioned above may be changed depending on, for example, the level of the subject who performs the muscle strength enhancement method involving the restriction of blood flow, the age and sex of the subject, and which limb the muscle strength enhancement method is performed on, either the arm or the leg. As to the coefficient, individuals performing the muscle strength enhancement method can be divided into, for example, two categories: for persons in a certain category, a coefficient between 0.6 and 0.75 may be used, and for persons in the other category, a coefficient between 0.75 and 0.9 may be used. The former makes the effects in improving the safety of the muscle strength enhancement method involving the restriction of blood flow and avoiding fear and anxiety of a performer prominent, which is often suitable for the elderly or physically weak persons. The latter further makes effect of the muscle strength enhancement prominent. In this way, when two or more coefficients are used, any of which can arbitrarily be selected by an instructor such as a physician or a trainer or an individual who performs the muscle strength enhancement method by operating the operation unit 16.

In this embodiment, the coefficient is set at 0.85. With this, for example, when the maximum pulse wave pressure is 200 mmHg, the appropriate pressure is given by: 200 mmHg×0.85=170 mmHg. When the maximum pulse wave pressure is 140 mmHg, the appropriate pressure is given by: 140 mmHg×0.85=119 mmHg.

While the calculation in this embodiment is performed by multiplying the maximum pulse wave pressure by a coefficient as described above, the appropriate pressure calculating unit 12F can be configured to obtain the appropriate pressure by subtracting a certain pressure from the maximum pulse wave pressure. The predetermined pressure that the appropriate pressure calculating unit 12F subtracts from the maximum pulse wave pressure can be, for example, 10-50 mmHg, and 20 mmHg in this embodiment. With this, for example, when the maximum pulse wave pressure is 200 mmHg, the appropriate pressure is given by: 200 mmHg−20 mmHg=180 mmHg. When the maximum pulse wave pressure is 140 mmHg, the appropriate pressure is given by: 140 mmHg−20 mmHg=120 mmHg. The aforementioned predetermined pressure subtracted from the maximum pulse wave pressure can be varied depending on, for example, the level of the subject who performs the muscle strength enhancement method involving the restriction of blood flow, the age and sex of the subject, and which limb the muscle strength enhancement method is performed on, either the arm or the leg. As in the case where the two or more predetermined coefficients are used, two or more values can be used for the pressure to be subtracted from the maximum pulse wave pressure.

The appropriate pressure is obtained in this way. The appropriate pressure calculating unit 12F is configured to generate, after the determination of the appropriate pressure, the appropriate pressure data representing the appropriate pressure and send it to the main control unit 12C.

The appropriate pressure is displayed on the display unit 17 as a result of the transmittance of the image data generated with the main control unit 12C to the display unit 17. The appropriate pressure data is sent to the recording unit 18 via the output unit 12B with the main control unit 12C of the control unit 12 and recorded on the recording unit 18.

With the appropriate pressure data recorded on the recording unit 18, an instructor operates the operation unit 16 to shift the mode of the compression pressure control device 1 to the training mode. Transition to the training mode is performed with the main control unit 12C based on the data supplied from the operation unit 16.

When the training mode is executed, the control unit 12 sends the appropriate pressure data that the main control unit 12C has read from the recording unit 18 to the pressure control unit 12D. The pressure control unit 12D generates the first control data based on the appropriate pressure data and sends it to the pressurizing pumps 11*a* and 11*b*. Thus, the pressurizing pumps 11*a* and 11*b* are driven under the control of the first control data, and the air is supplied to the gas bladders 2X of the constricting bands 8*a* and 8*b* of the compression bands 2*a* and 2*b* wrapped around the limbs of the subject. The pressure in the gas bladders 2X is considered as the appropriate pressure according to the appropriate pressure data recorded on the recording unit 18 described above. The result is that the appropriate pressure is applied to the limbs of the subject.

The subject may then perform the BFR training without any further modification. In this case, compression band 2*a*, 2*b* are kept connected to the compression pressure control device 1. When the subject moves in this state, the pressure of the air in the gas bladder 2X can rise. In such a case, the pressure in the gas bladder 2X can be kept constant by the pressure control unit 12D's generation of the second control data to cause the proportional valve 15*a*, 15*b* to be driven. The subject may perform the BFR training after removing the valve-equipped coupler 9*a*, 9*b* of the compression band 2*a*, 2*b* from the rubber tube 3*a*, 3*b*.

BFR training may be performed in combination with some exercise or may not. It should be noted that, unless the valve of the valve-equipped coupler 9*a*, 9*b* is operated, the pressure applied to the limb of the subject by the compression band 2*a*, 2*b* can be kept even after the valve-equipped coupler 9*a*, 9*b* of the compression band 2*a*, 2*b* is removed from the rubber tube 3*a*, 3*b*.

Also, during the training mode, whether the training mode has completed is monitored with the timer of the pressure control unit 12D of the control unit 12. When a predetermined compression time set by the instructor has passed, it is determined that the training mode has completed and the training mode is thus terminated. The pressurizing pump 11*a*, 11*b* that has received the first control data generated with the pressure control unit 12D removes the air from the gas bladder 2X. With this, the compression to the limb using the compression band 2*a*, 2*b* is stopped.

The invention claimed is:

1. An appropriate pressure determination device configured for use in an appropriate pressure determination system that includes:

a constricting device comprising:

a band having a length that enables the band to be wrapped around a predetermined portion of a limb;

securing means for securing the band with the band wrapped around the predetermined portion; and a gas bladder provided on or in the band, the gas bladder being for applying a predetermined compression pressure to the predetermined portion to compress the predetermined portion by being filled with a gas with the band wrapped around the predetermined portion being secured with the securing means;

pressure changing means configured to set a pressure of the gas in the gas bladder to a desired pressure; and pulse wave measuring means for measuring a predetermined parameter and generating pulse wave data for the predetermined parameter near the predetermined portion or on a distal side from the predetermined portion, the predetermined parameter varying depending on a fluctuation of a magnitude of a pulse wave in an artery, the magnitude changing depending on compression pressure;

the appropriate pressure determination device comprising:

pressure control means for controlling the pressure changing means in order to change the compression pressure, the pressure control means being configured to control the pressure changing means so that the pressure of the gas in the gas bladder changes across and beyond a range within which a pulse wave is expected to be maximum;

maximum pulse wave pressure specifying means for specifying a maximum pulse wave pressure that is a pressure of the gas in the gas bladder at a time when the pulse wave reaches its maximum by receiving the pulse wave data from the pulse wave measuring means a plurality of times while the pressure in the gas bladder is changing; and appropriate pressure calculating means for obtaining an appropriate pressure smaller than the maximum pulse wave pressure by performing a predetermined calculation on the maximum pulse wave pressure, wherein the appropriate pressure is obtained with the appropriate pressure calculating means by multiplying the maximum pulse wave pressure by a coefficient within a range between 0.6 and 0.9, and wherein the appropriate pressure determination device is configured to serve as a muscle strength enhancement device by controlling the pressure changing means with the pressure control means so that the pressure of the gas in the gas bladder is kept at the appropriate pressure after the appropriate pressure has been determined.

2. The appropriate pressure determination device according to claim 1, wherein the pressure control means controls, prior to generation of the pulse wave data, the pressure changing means in such a manner that the pressure changing means raises the pressure in the gas bladder to a pressure higher than a pressure at which the pressure is expected to exceed the maximum pulse wave pressure, and then reduces the pressure in the gas bladder.

3. The appropriate pressure determination device according to claim 2, wherein the pulse wave measuring means is configured so that the pressure of the gas in the gas bladder can be measured as the predetermined parameter.

4. The appropriate pressure determination device according to claim 1, wherein the pulse wave measuring means is configured so that the pressure of the gas in the gas bladder can be measured as the predetermined parameter.

5. An appropriate pressure determination system comprising:

a constricting device comprising:

a band having a length that enables the band to be wrapped around a predetermined portion of a limb;

securing means for securing the band with the band wrapped around the predetermined portion; and a gas bladder provided on or in the band, the gas bladder being for applying a predetermined compression pressure to the predetermined portion to compress the predetermined portion by being filled with a gas with the band wrapped around the predetermined portion being secured with the securing means;

pressure changing means configured to set a pressure of the gas in the gas bladder to a desired pressure;

pulse wave measuring means for measuring a predetermined parameter and generating pulse wave data for the predetermined parameter near the predetermined portion or on a distal side from the predetermined portion, the predetermined parameter varying depending on a fluctuation of a magnitude of a pulse wave in an artery, the magnitude changing depending on compression pressure;

pressure control means for controlling the pressure changing means in order to change the compression pressure, the pressure control means being configured to control the pressure changing means so that the pressure of the gas in the gas bladder changes;

maximum pulse wave pressure specifying means for specifying a maximum pulse wave pressure that is a pressure of the gas in the gas bladder at a time when the pulse wave reaches its maximum by receiving the pulse wave data from the pulse wave measuring means a plurality of times while the pressure in the gas bladder is changing; and appropriate pressure calculating means for obtaining an appropriate pressure smaller than the maximum pulse wave pressure by performing a predetermined calculation on the maximum pulse wave pressure, wherein the appropriate pressure is obtained with the appropriate pressure calculating means by multiplying the maximum pulse wave pressure by a coefficient within a range between 0.6 and 0.9, and wherein the appropriate pressure determination system is configured to serve as a muscle strength enhancement system by controlling the pressure changing means with the pressure control means so that the pressure of the gas in the gas bladder is kept at the appropriate pressure after the appropriate pressure has been determined.

6. A method for determining an appropriate pressure performed with an appropriate pressure determination system that includes:

a constricting device comprising:

a band having a length that enables the band to be wrapped around a predetermined portion of a limb;

securing means for securing the band with the band wrapped around the predetermined portion; and a gas bladder provided on or in the band, the gas bladder being for applying a predetermined compression pressure to the predetermined portion to compress the predetermined portion by being filled with a gas with the band wrapped around the predetermined portion being secured with the securing means;

pressure changing means configured to set a pressure of the gas in the gas bladder to a desired pressure; and pulse wave measuring means for measuring a predetermined parameter and generating pulse wave data for the predetermined parameter near the predetermined portion or on a distal side from the predetermined portion, the predetermined parameter varying depending on a fluctuation of a magnitude of a pulse wave in an artery, the magnitude changing depending on compression pressure;

the method comprising:

controlling the pressure changing means in order to change the compression pressure, so that the pressure of the gas in the gas bladder is changed with the pressure changing means;

specifying a maximum pulse wave pressure that is a pressure of the gas in the gas bladder at a time when the pulse wave reaches its maximum by receiving the pulse wave data from the pulse wave measuring means a plurality of times while the pressure in the gas bladder is changing;

obtaining an appropriate pressure smaller than the maximum pulse wave pressure by performing a predetermined calculation on the maximum pulse wave pressure, wherein the appropriate pressure is obtained by multiplying the maximum pulse wave pressure by a coefficient within a range between 0.6 and 0.9; and controlling the pressure changing means so that the pressure of the gas in the gas bladder is kept at the appropriate pressure after the appropriate pressure has been determined, thereby allowing the appropriate pressure determination system to serve as a muscle strength enhancement system.

* * * * *